US007773461B1

(12) United States Patent
Crosby, Sr.

(10) Patent No.: US 7,773,461 B1
(45) Date of Patent: Aug. 10, 2010

(54) METHOD AND APPARATUS FOR TENNIS WATCH

(76) Inventor: Shedrick B. Crosby, Sr., 683 Bullard Ave., Pensacola, FL (US) 32514

( * ) Notice: Subject to any disclaimer, the term of this patent is extended or adjusted under 35 U.S.C. 154(b) by 154 days.

(21) Appl. No.: 12/150,260

(22) Filed: Apr. 28, 2008

(51) Int. Cl.
*G04B 47/00* (2006.01)

(52) U.S. Cl. ..... 368/10

(58) Field of Classification Search ..... 368/10, 368/87, 155, 217, 239, 242, 29, 112, 30, 368/34, 70, 85; 715/856; 377/5, 13; 340/323 R; 273/DIG. 26; 700/92
See application file for complete search history.

(56) References Cited

U.S. PATENT DOCUMENTS

| | | | | |
|---|---|---|---|---|
| 3,730,131 | A * | 5/1973 | Izzo | 116/223 |
| 4,483,628 | A | 11/1984 | Terzian | |
| 4,510,485 | A | 4/1985 | Tahara | |
| 4,738,449 | A | 4/1988 | Droz | |
| 4,991,156 | A | 2/1991 | Suga | |
| 5,050,141 | A | 9/1991 | Thinesen | |
| 5,134,565 | A * | 7/1992 | Herbertz | 340/323 R |
| 5,343,446 | A | 8/1994 | Simmons et al. | |
| D369,754 | S | 5/1996 | Donaldson | |
| 5,898,751 | A * | 4/1999 | Yakoby et al. | 377/5 |
| 6,634,548 | B1 * | 10/2003 | Bowman | 235/1 B |
| 7,300,366 | B1 * | 11/2007 | Hickey | 473/522 |
| 2002/0101457 | A1 * | 8/2002 | Lang | 345/856 |

FOREIGN PATENT DOCUMENTS

| | | | |
|---|---|---|---|
| DE | 4041419 | A1 | 9/1991 |
| JP | 58129283 | A | 8/1983 |
| JP | 6107 3087 | A | 4/1986 |

* cited by examiner

*Primary Examiner*—Edwin A. Leon
(74) *Attorney, Agent, or Firm*—George L. Williamson

(57) ABSTRACT

Method and apparatus for a tennis watch having a watch-like case containing a central processing unit and an input/output controller connected to the central processing unit, a display driver that takes data from the central processing unit and converts it into the electrical signals required by the alphanumeric display, a program read only memory ROM connected to the central processing unit wherein the ROM contains the operating program for the tennis watch and a clock circuit connected to the CPU. The tennis watch case also comprises an alphanumeric screen having an luminescent background which displays various tennis related data controlled by a plurality of buttons disposed on the watch case.

2 Claims, 3 Drawing Sheets

METHOD AND APPARATUS FOR TENNIS WATCH

BACKGROUND OF THE INVENTION

1. Field of the Invention

The present invention generally relates to wrist watches and, more particularly, to wrist watches that provide scores to the user while the game of tennis is being played.

2. Description of the Prior Art

Various types of watches have been described in the prior art, however, none of the prior art devices disclose the unique features of the present invention. While the convention wrist watches keep basic time, none of them keeps time, scores, and game stats specifically while playing the game of tennis like the present invention.

U.S. Pat. No. 5,343,446, dated Aug. 30, 1994 to Simmons, et al., disclosed a platoon schedule watch and a method of providing a schedule for a user of shift start time, both prospective and retrospective.

U.S. Pat. No. Des 369,754, dated May 14, 1996, to Donaldson, disclosed a tennis score keeper.

U.S. Pat. No. 5,050,141, dated Sep. 17, 1991 to Thinesen, disclosed a program to synchronize pace in a multi-mode alarm timepiece.

U.S. Pat. No. 4,483,628, dated Nov. 20, 1984 to Terzian, disclosed a balanced chronograph digital time display.

U.S. Pat. No. 4,510,485, dated Apr. 9, 1985, to Tahara, disclosed a sound generating device for a jogger.

U.S. Pat. No. 4,738,449, dated Apr. 19, 1988, to Droz, disclosed a score marker for tennis.

U.S. Pat. No. 4,991,156, dated Feb. 5, 1991, to Suga, disclosed an electronic time measuring apparatus including past record display means.

Also, Foreign patent documents include German Patent No. DE 4041419A1 to Heinz, September, 1991; Japan Patent No. JP58129283A to Ichikawa, dated August, 1983 and Japan Patent No. JP61073087A to Miyaoka, dated April, 1986.

While these watches may be suitable for the purposes for which they were designed, they would not be as suitable for the purposes of the present invention, as hereinafter described.

SUMMARY OF THE PRESENT INVENTION

The present invention discloses a method and apparatus for a watch-like case containing a central processing unit and an input/output controller connected to the central processing unit, a display driver that takes data from the central processing unit and converts it into the electrical signals required by the alphanumeric display, a program read only memory ROM connected to the central processing unit wherein the ROM contains the operating program for the present invention and a clock circuit connected to the CPU. The watch case also comprises an alphanumeric screen which has an luminescent background which displays various tennis related data and is controlled by a plurality of buttons disposed on the watch case.

There are underwater diving watches, skydiving watches, calculator watches, stopwatches, watches that tell basic time like: Eastern, Central, Pacific time zones, and overseas time, but no sports watch that keeps time and scores of a tennis match like the present invention. The scores are displayed digitally and DC cell powered. The scores, games, and aces are activated by pressing the associate letter and/or number for the appropriate functions. The scores, aces, and games can be cleared when an error is made, simply by pressing the corresponding button for two-three seconds. To clear all data, simply press clear once and hold the button down until it clears.

There are very few if any sports timing devices that address the problems of keeping the scores and games stats while a player plays the game of tennis by the use of a wrist watch.

Normally there are no coaches or umpires around to keep the scores. It is left up to the players to keep the scores. In the heat of the battle one or both players often forget the scores and could cause much confusion and arguments on and off the court.

Most clubs, high schools, and colleges have ten to twenty tennis courts which have no scoreboards nor any means of keeping the scores while playing the tennis matches other than the players themselves.

Another advantage of the present invention is that is portable, lightweight, and readily available for quick and easy push button scoring right at your fingertips. In normal match play, twenty-five seconds is the allotted time to prepare to serve for the next point. This is enough time to punch in your scores and stats and make any corrections. The present invention is reasonably priced and inexpensive to manufacture. It can be made of plastic, metal, gold, and/or silver, with a stainless steel backing, and electronic integrated circuitry.

Other advantages of the present invention are that the digital numbers are bigger and magnified for night play, also has an electro illuminasent background with a pushbutton light, so the younger and older players can see the numbers clearly. Also, the buttons are fewer and bigger than calculator watches. Calculator Wristwatch buttons are much smaller in size needing the assistance of a pencil or some form of pointer to press the buttons. Can you imagine the dangers of running around the tennis court with a sharp instrument in your pants pocket or under your skirt. To use the present invention you only need one to two fingers to press the buttons. You don't even have to go to your seat to keep score.

Another advantage is that you can set your present invention alarm in case of a long set or a long tie-break, and let the watch be the judge.

An object of the present invention is to provide a wrist watch namely the present invention, that keeps the time, scores, and game stats while playing the game of tennis. This is done by pressing fewer buttons that are larger in size, as well as having a larger watch face than your typical watch face. The reason this is done is to accommodate the information stored as well as to be given, and the electronic technology of the present invention.

Another objective, this wrist watch is water resistant due to the sweating of the tennis athletes. Also, it is shock absorbent due to the roughness of the sport. It is made of plastic, metal. Yet another objective is to provide a wrist watch that is simple to operate and inexpensive to manufacture. Yet another objective is that the present invention could be worn around the wrist sweatband due to the making of many types of large wrist watch bands. Many tennis Pros wear their watches and jewelry while playing.

To the accomplishment of the above and related objects, this invention may be more concrete and perceptible in the form illustrated in the accompanying drawing, attention being called to the fact, however, that the drawing is an illustration only.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
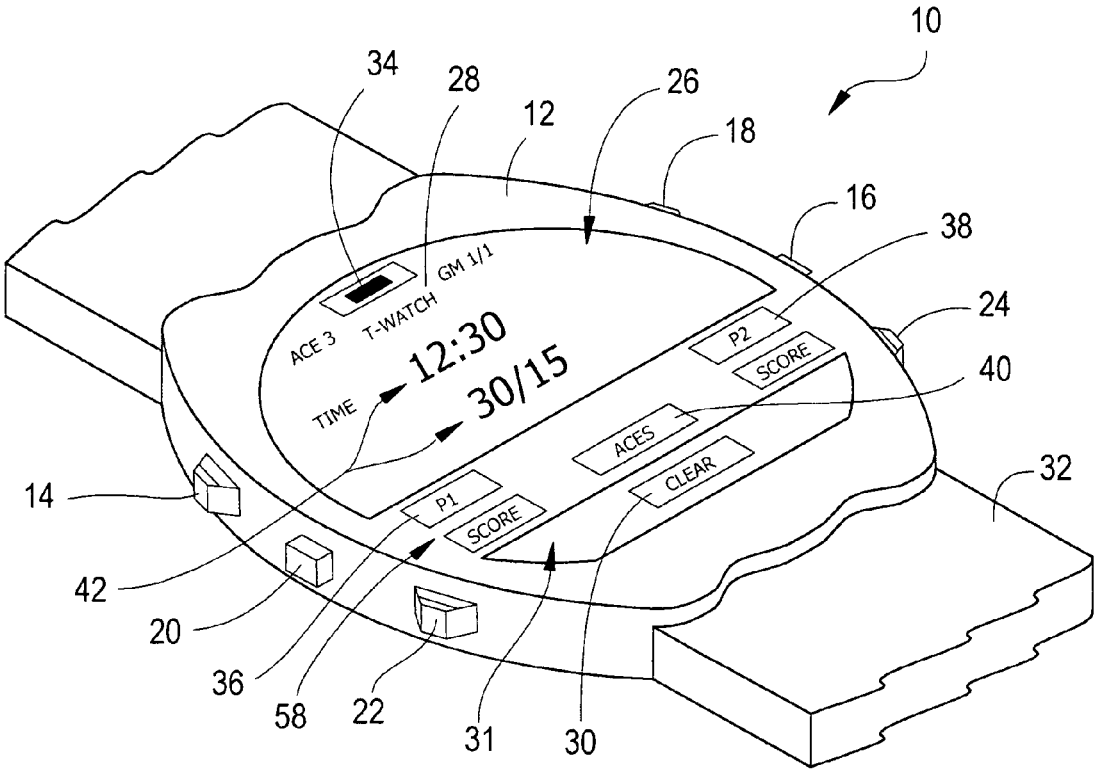
FIG. 1 is a perspective view of the present invention.

With regard to reference numerals used, the following numbering is used throughout the drawings.

10 present invention
12 watch case
14 mode set button
16 lap/reset button
18 alarm/chronograph (ST/SP)
20 tennis mode button
22 game one (1) button
24 game two (2) button
26 electro luminescence background
28 tennis watch logo
30 clear button
31 clear region
32 watch band
34 light button
36 player one (1) button
38 player two (2) button
40 ace(s) button
42 alphanumeric display region
44 alphanumeric LCD display screen
46 CPU I/O controller
48 Program ROM
50 LCD display driver
52 clock circuit
54 light
56 piezo transducer
58 score button region
60 power supply
62 gates

DETAILED DESCRIPTION OF THE PREFERRED EMBODIMENT

Figure 2:
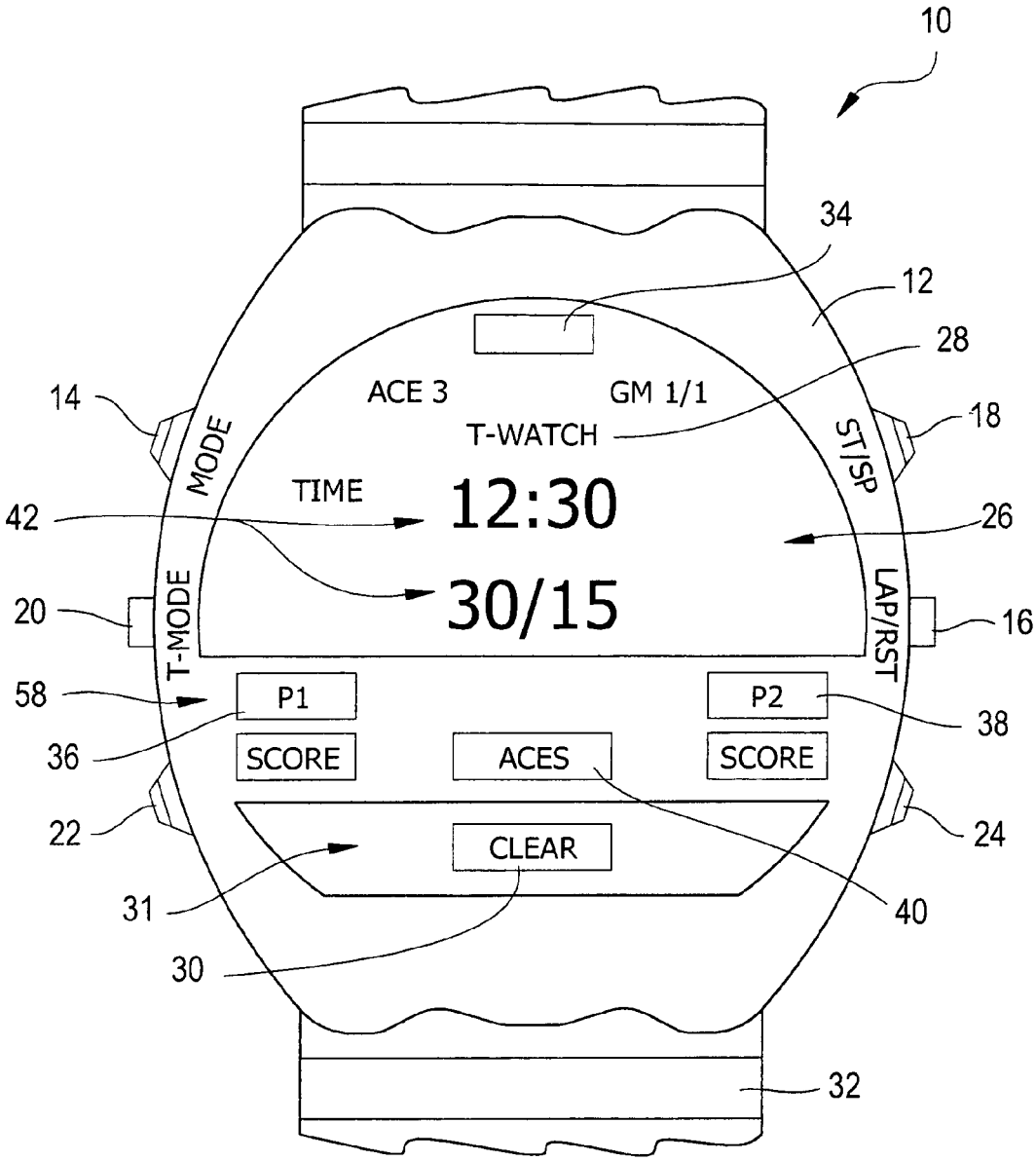
FIG. 2 is a plan view of the present invention.
Figure 3:
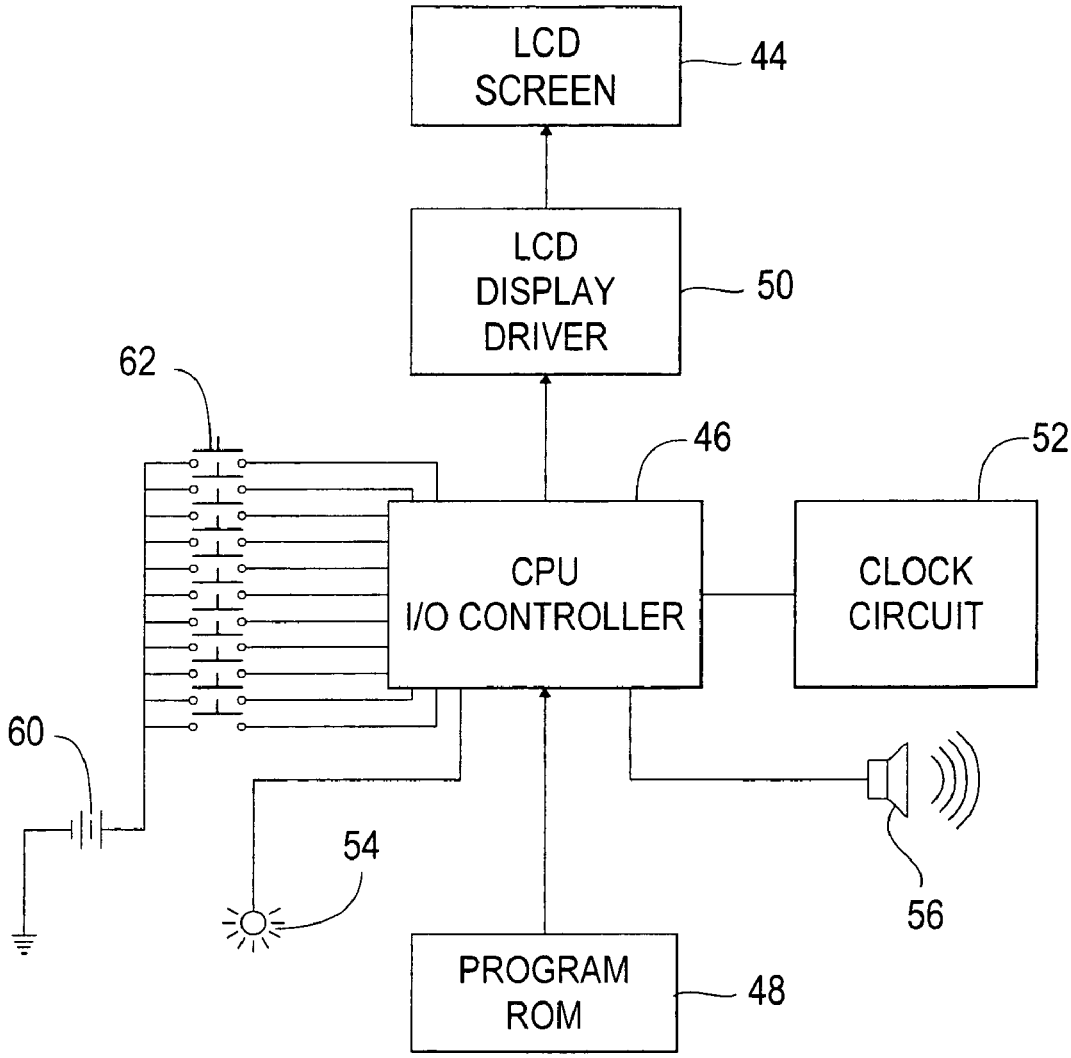
FIG. 3 is an electronic block diagram of the present invention.

The following discussion describes in detail the present invention. FIGS. 1-3 illustrate the present invention wherein a tennis watch is disclosed.

The present invention resembles a large conventional wrist watch and has the same form factor. It may be worn as a wrist watch with band, or it may be worn as a pendant watch, or a clip-on, or like a necklace, chain, or rope style. Approximate dimensions are as follows: width is 1⅞ inch, length is 2⅛ inch, and the height is ½ inch.

Turning to FIGS. 1 and 2, the present invention 10 displays both conventional data (chronograph mode) and tennis data (tennis mode) on an alphanumeric display screen 42. This may be an LCD display, LED display, electro luminescent display, or any other suitable display. The present invention 10 includes a computer (Item 46 on FIG. 3) which is operable in a chronograph mode and/or a tennis mode.

The present invention has eleven (11) operating means, which means could include buttons, switches, tabs, keys or the like which allow user controlled/selectable input of data/signals into a computer. The operating means include mode (14), LAP/RST (16), ST/SP (18), T-Mode (20), game 1 (22), game 2 (24), clear (30), light (34), player 1 (36), player 2 (38), and aces (40). The mode button, dual function time/date set button 14 is used to set the time and date in a manner similar to a conventional watch. The lap/countdown timer button 16 allows the lap function to be used to time laps when the present invention is used as a chronograph. The countdown timer function is used to set tennis court time, tie breaks, and long sets due to overlapping time on the court and when set to go off in ten 90-minute increments an alarm will sound. The dual function alarm/chronograph set button 18, shown as ST/SP on FIGS. 1-2, is used in a manner similar to a conventional watch. Tennis mode (T-Mode) button 20 is used to switch between display mode activities, e.g., time and date, and Tennis Mode functions which are: players 1 and 2 (36 and 38) buttons are used when a player has scored, then the score will be displayed on the alphanumeric display screen. Games 1 and 2 (22 and 24) buttons are used when a player is the winner of a game in a set. The ace button 40 is used when the server serves an Ace. The score seen on the alphanumeric display screen 42 is a sum of total points by both players within a game. The time is actual local time displayed on the alphanumeric screen 42. The alphanumeric screen 42 has an electro luminescent background 26. The alphanumeric screen 42 has three display regions including an upper region 42, middle region 58 and lower region 31. In region 42 the alphanumeric data is displayed. In region 58 the score is displayed. In region 30 the clear button is displayed. The clear button 30 is used to clear all tennis data except the time on the alphanumeric display screen 42. The present invention has a light button 34 for night play and conventional watch functions.

The detailed operation of the present invention is further illustrated by reference to FIG. 3 showing exemplary electronic circuitry for the present invention. The present invention is expected to be powered by a three (3) volt lithium battery cell.

By way of further explanation of the operation of the present invention 10 as seen in FIGS. 1-2, an alphanumeric screen 42 disposed on the watch case 12 displays both conventional and tennis data on the alphanumeric display screen. In the tennis mode, in the beginning of the game on the first set, all data is cleared except for the time. The player scoring the first points will appear on the alphanumeric display in the score section by pressing the corresponding player 1 or 2 button, (36, 38). Aces are recorded when the server aces his opponent by simply pressing the ACE button 40 and that player will press PLAYER 1 button which is the server button also, and that point should appear on side 1 of the score shown at 58. If the opponent (player 2) scores the user will press the player 2 button (24). This scoring process will continue until one of the players wins the last point after forty. Points are scored starting at Love, 15, 30, 40, and, Game. Games are recorded once a player wins a game by pressing games 1 or 2 button (GM1 or GM2) (22, 24) and the number of games will appear in the GAMES section (GM 1/1) shown in the alphanumeric display on the present invention. When an error is made on any of the Tennis mode functions, the user presses the clear button once. Then that player should reenter the correct scores, games, or aces by repressing the corresponding button(s) on the alphanumeric display screen 42. The user clears all tennis data by pressing the CLEAR button 30 once, and holding the button down until it clears, then the alphanumeric display screen should read zero for all Tennis Mode functions on the watch.

Turning o FIG. 3, electronic circuitry for the conventional mode and tennis mode functions of the present invention 10 are disposed within the watch case (see item 12 of FIG. 1) comprising a central processing unit and an input/output controller connected to the central processing unit at 46, a display driver 50 that takes data from the central processing unit and converts it into the electrical signals required by the alphanumeric display or screen 44, a program read only memory ROM 48 connected to the central processing unit wherein the ROM contains the operating program for the present invention and a clock circuit 52 connected to the CPU. A MODE button allows a user to select the mode of data to be displayed. A LAP/COUNTDOWN TIMER button 16 allows the LAP function to be used to time laps when the present invention is used as a chronograph. The COUNTDOWN TIMER function is used to set tennis court time, tie breaks, and long sets due to overlapping time on the court and when set to go off in ten 90-minute increments an alarm will sound. A transducer 56 that converts the electrical signals into sound for audible alarms along with a light 54. A power supply 60 and multiple gates 62 are also shown. The present invention 10 is also water resistant.

In summary, the present invention 10 discloses an apparatus that provides scoring and number of games played for both players and aces by the server in a game, set, and match instantly at the press of a button(s) in the Tennis Mode function while playing the game of tennis. The present invention 10 also has conventional timer mode functions. The present invention 10 is equipped with a countdown timer function to prevent overlapping of tennis court time and tie breaks and long sets. The present invention 10 has a CLEAR button 30 to clear all data on the alphanumeric display screen, except the time in the tennis mode only. The present invention 10 is embodied with electronic integrated circuitry, Input/Output central processing unit, program ROM, LCD display driver, and an LCD display screen with a luminescent background.

I claim:

1. An apparatus for being worn by a user, the apparatus for providing the time and date, and, for keeping score of a tennis match, comprising:

a) a case for containing the apparatus, wherein said case is complementarily sized and shaped like a large wrist watch for being worn by a user;

b) said case having three distinct display regions comprising an upper region for displaying time and date, a middle region for displaying the score, and a lower region containing a clear button;

c) a clock for producing reference clock signals;

d) a computer disposed in said case for receiving signals from said clock and for controlling the display regions, said computer having a chronograph mode providing time and date related data and a tennis mode providing tennis match related data;

e) a first user controlled input means for switching said computer between said chronograph mode and said tennis mode;

f) a second user controlled input means for inputting into said computer a user selected time and date for use in said chronograph mode for display in said display upper region, said selected time being displayed during both said chronograph and tennis modes;

g) a third user controlled input means for inputting into said computer a user selected lap timer for use in said chronograph mode for display in said display upper region area;

h) a fourth user controlled input means for inputting into said computer a user selected alarm for use in said chronograph mode for display in said display upper region;

i) fifth and sixth user controlled input means for inputting a tennis score of a first and second tennis player, respectively, into said computer for use in said tennis mode for display in said display middle region, a score display for each player being located adjacent said fifth and sixth user controlled input means, the scores of said first and second tennis players also being displayed side by side in said display upper region;

j) seventh and eighth user controlled input means located on opposite sides of said case for inputting the games won by the first and the second tennis player, respectively, into said computer for use in said tennis mode for display in said display upper region;

k) a ninth user controlled input means for inputting the aces made by the first and the second tennis player into said computer for use in said tennis mode for display in said display upper region;

l) a tenth user input means in said lower region for inputting into said computer a command from a user comprising a button to correct an erroneous input signal or to clear all tennis data from said upper and lower display regions for use in said tennis mode for display in said display area and leaving a time display undisturbed, said seventh, eighth, ninth and tenth user controlled means being thereby arranged to allow scores, stats and corrections to be entered during twenty-five seconds, the allotted time to prepare to serve for the next point; and m) an eleventh user controlled input means located in said upper region for inputting into said computer a command for the user to light said display area for night-time use of the apparatus.

2. A method for providing the time and date, and, for keeping score of a tennis match, comprising:

a) providing a case for containing the apparatus, wherein the case is complimentarily sized and shaped like a large wrist watch for being worn by a user;

b) providing a display area on the case so as to be visible to a user, said display area comprising upper, middle and lower regions;

c) providing a clock for producing reference clock signals;

d) providing a computer in the case for receiving signals from the clock and for controlling the display area, the computer having a chronograph mode providing time related data and a tennis mode providing tennis match related data;

e) providing a first user controlled input means for switching the computer between the chronograph mode and the tennis mode;

f) providing a second user controlled input means for inputting into the computer a user selected time and date for use in the chronograph mode for display in the display upper region, said selected time being displayed during both said chronograph and tennis modes;

g) providing a third user controlled input means for inputting into the computer a user selected lap timer for use in chronograph mode and display in the display upper region;

h) providing a fourth user controlled input means for inputting into the computer a user selected alarm for use in chronograph mode and display in the display upper region;

i) providing a fifth and sixth user controlled input means for inputting the tennis scores of a first and second tennis player, respectively, into the computer during chronograph mode and display in the display middle region, a score display for each player being located adjacent said fifth and sixth user controlled input means, the scores of said first and second tennis players also being displayed side by side in said display upper region;

j) providing a seventh and eighth user controlled input means for inputting the games won by the first and the second tennis player, respectively, into the computer during chronograph mode and display in the display upper region;

k) providing a ninth user controlled input means for inputting the aces made by the first and the second tennis player into the computer during chronograph mode and display in the display upper region;

l) providing a tenth user controlled input means in said lower region for inputting into the computer a command from a user to clear all tennis data from the display area during chronograph mode and display in the display area and leaving a time display undisturbed;

m) providing an eleventh user controlled input means for inputting into the computer a command from the user to light the display area for night-time use of the apparatus; and, n) operating each of the user controlled input means effectively fast so that the apparatus can calculate the score of a tennis match within a maximum of twenty-five seconds within the allotted time for compliance with the rules of tennis.

* * * * *